United States Patent [19]

Lenny

[11] Patent Number: 4,957,214

[45] **Date of Patent: * Sep. 18, 1990**

[54] MODIFICATION TO FLOATING ROOF TANK DESIGN

[75] Inventor: Leslie M. Lenny, Caringbah, Australia

[73] Assignee: California Texas Oil Corporation, Irving, Tex.

[ * ] Notice: The portion of the term of this patent subsequent to Dec. 13, 2005 has been disclaimed.

[21] Appl. No.: 235,606

[22] Filed: Aug. 24, 1988

Related U.S. Application Data

[63] Continuation of Ser. No. 910,298, Sep. 17, 1986, Pat. No. 4,790,447, which is a continuation of Ser. No. 723,008, Apr. 16, 1985, abandoned, which is a continuation of Ser. No. 531,506, Sep. 12, 1983, abandoned.

[30] Foreign Application Priority Data

Sep. 13, 1983 [AU] Australia ..... PF5853

[51] Int. Cl.[5] ..... B65D 88/40

[52] U.S. Cl. ..... 220/220; 220/216; 137/172; 210/172; 210/533

[58] Field of Search ..... 220/216, 217, 218, 219, 220/220, 221, 223, 224, 225, 226, 227, 82 R, 222; 210/172, 521, 522, 522.1, 533, 536, DIG. 9; 137/1, 172, 264, 561 R, 574; 222/62, 67

[56] References Cited

U.S. PATENT DOCUMENTS

| | | | |
|---|---|---|---|
| 326,580 | 9/1885 | Minor et al. | 122/431 |
| 676,755 | 6/1901 | Melcher | 210/473 |
| 1,113,683 | 10/1914 | Pfahler | 210/313 |
| 1,135,900 | 4/1915 | Hughson | 210/172 |
| 1,232,370 | 7/1917 | Morison | 210/172 |
| 1,254,058 | 1/1918 | Morgan | 210/153 |
| 1,314,140 | 8/1919 | Jacobus | 210/153 |
| 1,406,950 | 2/1922 | Fackert | 210/800 |
| 1,457,065 | 5/1923 | Johnson | 220/22 |
| 1,530,077 | 3/1925 | Haynes | 210/533 |
| 1,548,400 | 8/1925 | Walker | 210/172 |
| 1,592,244 | 7/1926 | Wiggins | 220/219 |
| 1,714,338 | 5/1929 | Yelmgren | 210/534 |
| 1,734,622 | 11/1929 | Griffin | 220/216 |
| 1,768,209 | 6/1930 | Miller | 210/634 |
| 1,829,732 | 11/1931 | Allen | 210/172 |
| 1,831,898 | 11/1931 | Wignall | 137/172 X |
| 1,894,535 | 1/1933 | Laird | 220/220 X |
| 1,906,834 | 5/1933 | Beckwith | 222/62 |
| 2,002,407 | 5/1935 | Lemke | 210/533 |
| 2,008,686 | 7/1935 | Day | 220/219 |
| 2,237,461 | 4/1941 | Tokheim | 220/221 |
| 2,287,212 | 6/1942 | Wiggins | 220/220 |
| 2,321,058 | 6/1943 | Wiggins | 220/219 |
| 2,329,967 | 9/1943 | Wiggins | 220/220 |
| 2,375,282 | 5/1945 | Clemens | 210/109 |
| 2,422,869 | 6/1947 | Wiggins | 137/398 |
| 2,439,792 | 4/1948 | Boardman | 220/217 |
| 2,460,258 | 1/1949 | Jones | 137/172 X |

(List continued on next page.)

FOREIGN PATENT DOCUMENTS

| | | |
|---|---|---|
| 0317084 | 8/1974 | Australia . |
| 0805512 | 3/1951 | Fed. Rep. of Germany . |
| 2071748 | 9/1981 | United Kingdom . |

*Primary Examiner*—Stephen Marcus
*Assistant Examiner*—Nova Stucker
*Attorney, Agent, or Firm*—Oblon, Spivak, McClelland, Maier & Neustadt

[57] ABSTRACT

The present invention relates to floating roof storage tanks, having a tank shell which is supported on a fixed base, and a floating roof supported by the liquid stored in the tank. Included in the base or roof is a displacement means to substantially displace the stored liquid when the floating roof is in its lowest position. In this way the volume of the heel of liquid unable to be removed from the tank is reduced. The displacement means can take the form of a container which protrudes downwardly from the roof, or a layer of ballast on the base of the tank. The ballast layer can be a liquid heavier than the stored liquid which can be retained in a dam if desired.

64 Claims, 15 Drawing Sheets

U.S. PATENT DOCUMENTS

| | | | |
|---|---|---|---|
| 2,493,166 | 1/1950 | Schmitz, Jr. | 210/172 |
| 2,715,465 | 8/1955 | Wood | 210/238 |
| 2,772,805 | 12/1956 | Grundig | 220/220 |
| 2,789,722 | 4/1957 | Oberst | 220/219 |
| 2,825,422 | 3/1958 | Schoenfeld | 55/166 |
| 2,896,657 | 7/1959 | Uhll et al. | 210/533 X |
| 2,917,924 | 12/1959 | Messick | 220/82 R |
| 2,924,350 | 2/1960 | Greer | 220/216 X |
| 2,947,437 | 8/1960 | Greer | 220/216 X |
| 3,206,031 | 9/1965 | Messa | 210/172 |
| 3,241,704 | 3/1966 | Marriott et al. | 220/216 X |
| 3,438,215 | 4/1969 | Frijlink | 220/222 X |
| 3,529,728 | 9/1970 | Middelbeek et al. | 210/522 |
| 3,535,236 | 10/1970 | Travis | 220/216 X |
| 3,592,009 | 7/1971 | Glijnis et al. | 405/53 |
| 3,680,729 | 8/1972 | Bonavent et al. | 220/216 X |
| 3,744,643 | 7/1973 | Tsunoda | 210/522 |
| 3,964,873 | 6/1974 | Aramaki et al. | 422/201 |
| 4,107,052 | 8/1978 | Yoshino et al. | 210/534 |
| 4,138,342 | 2/1979 | Middelbeek et al. | 210/522 |
| 4,170,877 | 10/1979 | Pickering | 60/592 |
| 4,230,138 | 10/1980 | Tanaka | 220/217 X |
| 4,244,487 | 1/1981 | Kern | 220/216 |
| 4,431,536 | 2/1984 | Thompson | 220/219 X |
| 4,537,211 | 8/1985 | Almeida | 137/1 |

MODIFICATION TO FLOATING ROOF TANK DESIGN

This is a continuation, of application Ser. No. 06/910,298, filed Sep. 17, 1986 U.S. Pat. No. 4,790,447 which is a continuation of 06/723,008 filed 04/16/85 abandoned, which is a continuation of 06/531,506 filed 09/12/83 abandoned.

The present invention relates to floating roof tanks of the type that are extensively used to store liquid hydrocarbon products such as crude oil, gasoline, and the like.

Oil refineries and storage terminals utilize floating roof tanks for the storage of hydrocarbon stocks which have a higher vapour pressure than products which can be stored in cone roof tanks. Typical of such products are gasoline, napthas and crude oil.

The filling and emptying cycle of such tanks is between a normal minimun to a normal maximum gauge (or depth) which typically is approximately 2 meters to approximately 14 meters respectively. The minimum gauge elevation is determined by the need to keep the underside of the roof clear of any projections into the tank (e.g. tank heaters, mixers, suction/rundown lines) and the requirement to provide sufficient head for pumping equipment connected to the tank. As all working movements in the tank are above the minimum gauge, the volume in the tank at minimum gauge, (or heel) is a static inventory which represents a high cost.

Typically a floating roof tank is at least approximately 20 meters in diameter. Thus a cylindrical heel 30 meters in diameter and 2 meters thick contains many barrels of valuable liquid. This liquid must be purchased but cannot be sold as it cannot be extracted from the tank whilst the tank remains in use.

It is know from U.S. Pats. Nos. 2,924,350; 2,947,437 and 3,167,203 to have a water/stored liquid interface which utilizes the fact that most hydrocarbons will float on water. However the arrangements of those patents are not directed to reducing heel inventory, and suffer from the severe disadvantage that maintenance of the tank wall, because of corrosion, must be carried out under water.

It is an object of the present invention to provide an improved storage tank which will permit much smaller volumes of product in the tank at minimum gauge and thereby reduce both the volume and cost of the static inventory.

In accordance with one aspect of the present invention there is disclosed a floating roof storage tank comprising a tank shell supported by a fixed base and a floating roof bouyantly supported by liquid in said tank, said roof including projections extending therefrom to support said roof at a minimum liquid level in said tank, wherein a displacement means is located within said tank to at least partially fill the volume between said base and said roof when said roof is at a minimum level. The displacement means preferably takes the form of a volume occupying arrangement located either on the base or on, and moveable with, the underside of the floating roof.

Some embodiments of the present invention will now be described with reference to the drawings in which.

Figure 1:
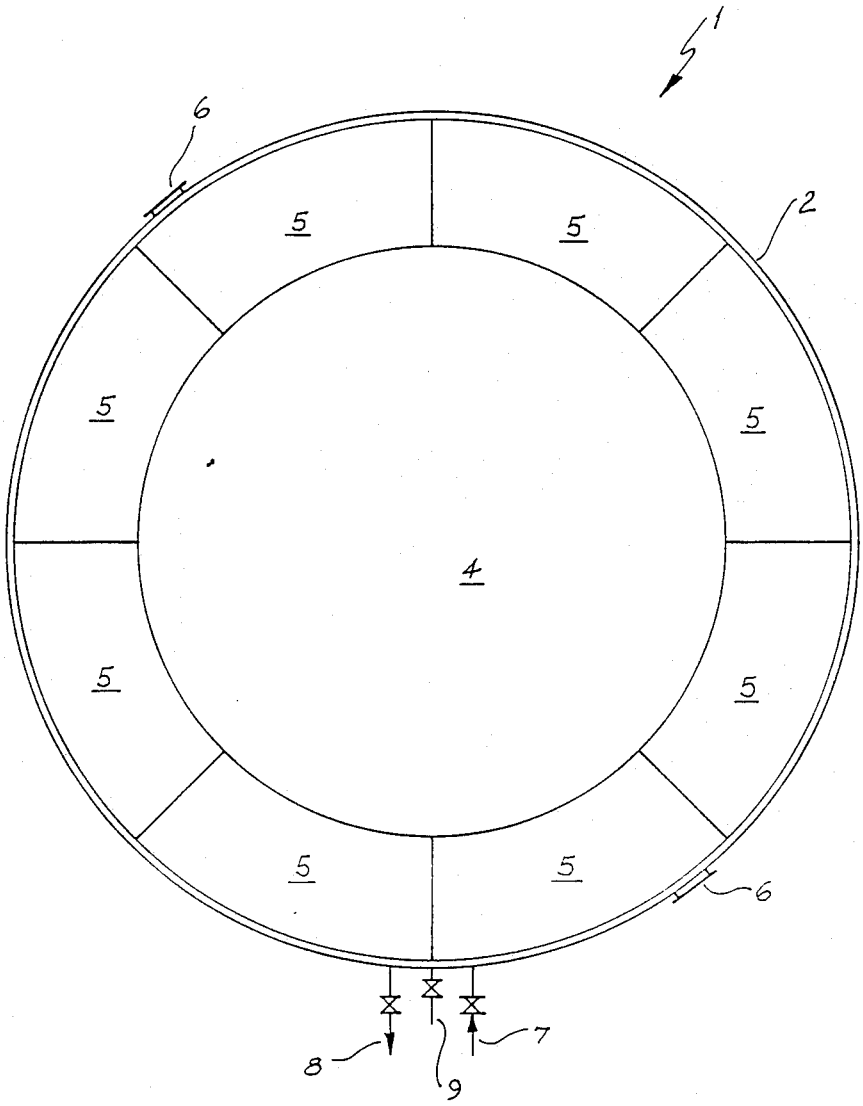
FIG. 1 PRIOR ART
FIG. 1 is a plan view of a conventional floating roof tank.
Figure 2:
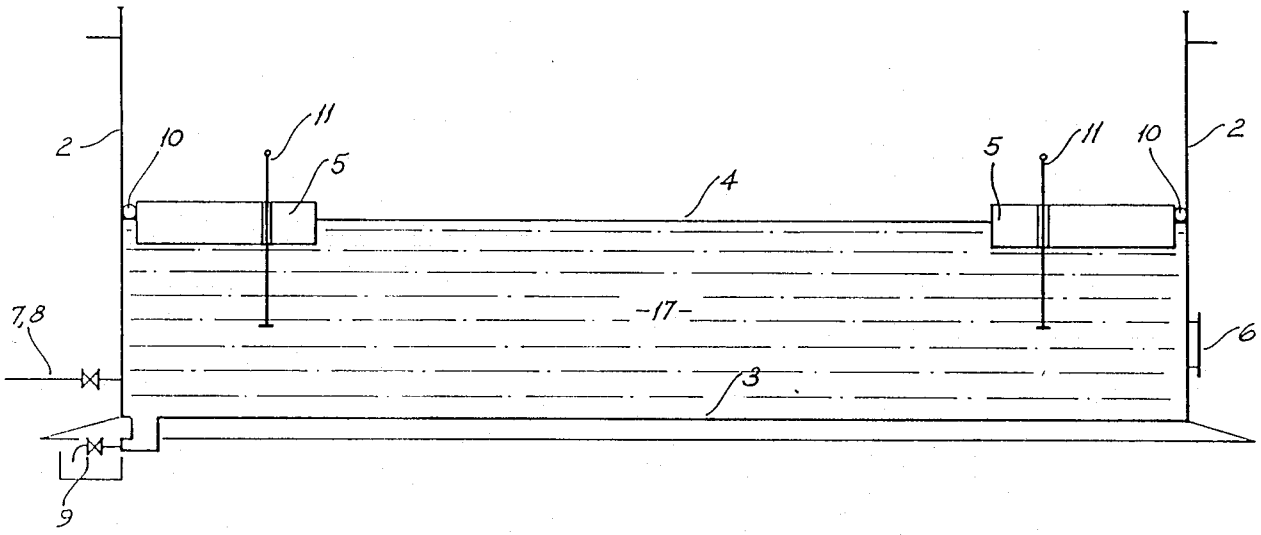
FIG. 2 PRIOR ART
FIG. 2 is a vertical cross-section of the tank of FIG. 1.

As illustrated in FIGS. 1 and 2, a conventional floating roof tank 1 comprises a tank shell 2, a base or tank floor 3, and a tank roof 4 floating on pontoons 5. As is standard on most tanks, there are manways 6, an inlet line 7 and an outlet line 8 and a drain 9, as well as roof legs 11 which are conventional and which prevent the roof 4 from contacting the base 3. The tank roof 4 floats on volatile liquid product 17 and rises and falls with the level of the liquid product 17. Seals 10 are provided around the circumference of the roof 4 to provide a seall with the tank shell 2.

Figure 3:
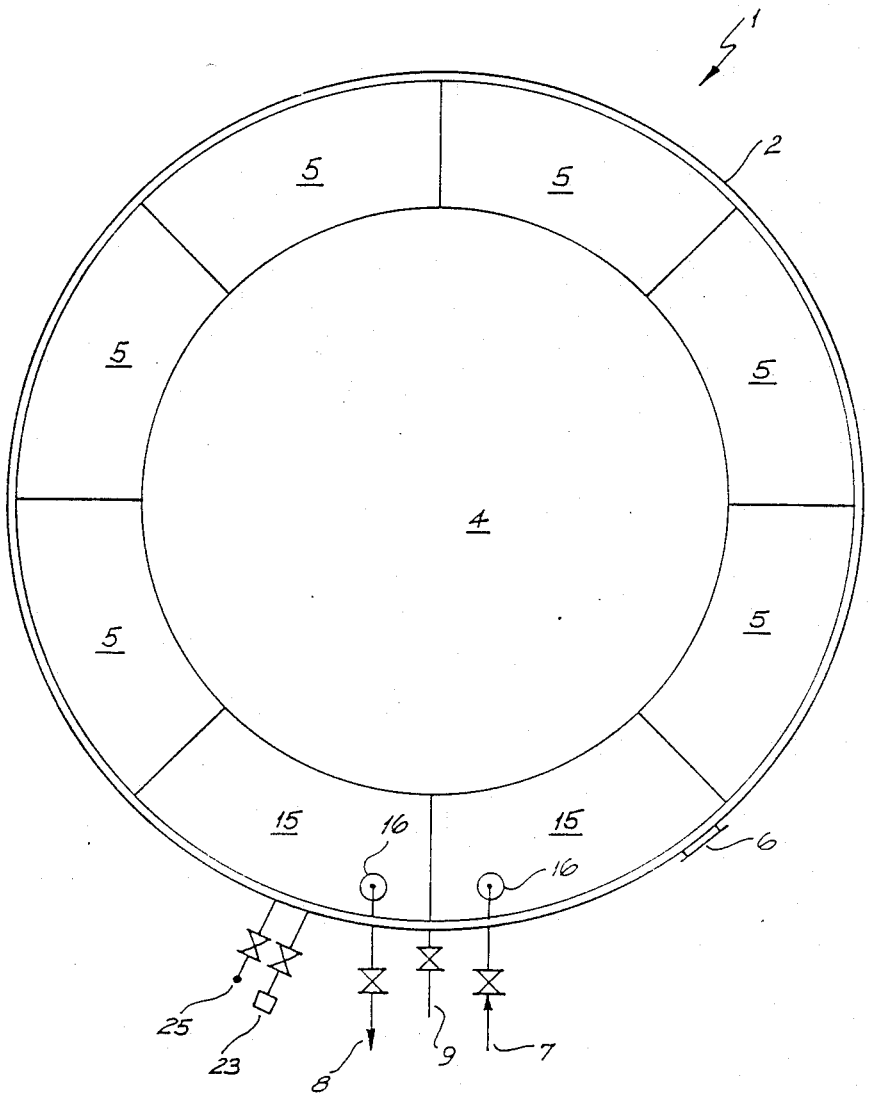
FIG. 3 is a plan view of a floating roof tank of a first embodiment of the present invention.
Figure 4:
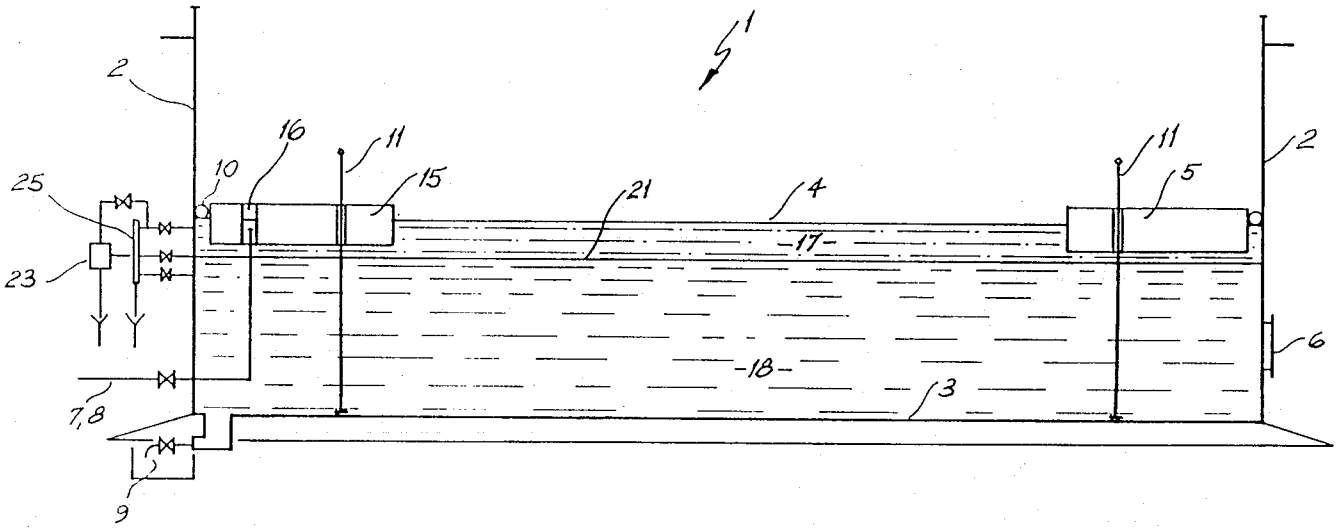
FIG. 4 is a vertical cross-section of the tank of FIG. 3.
Figure 5:
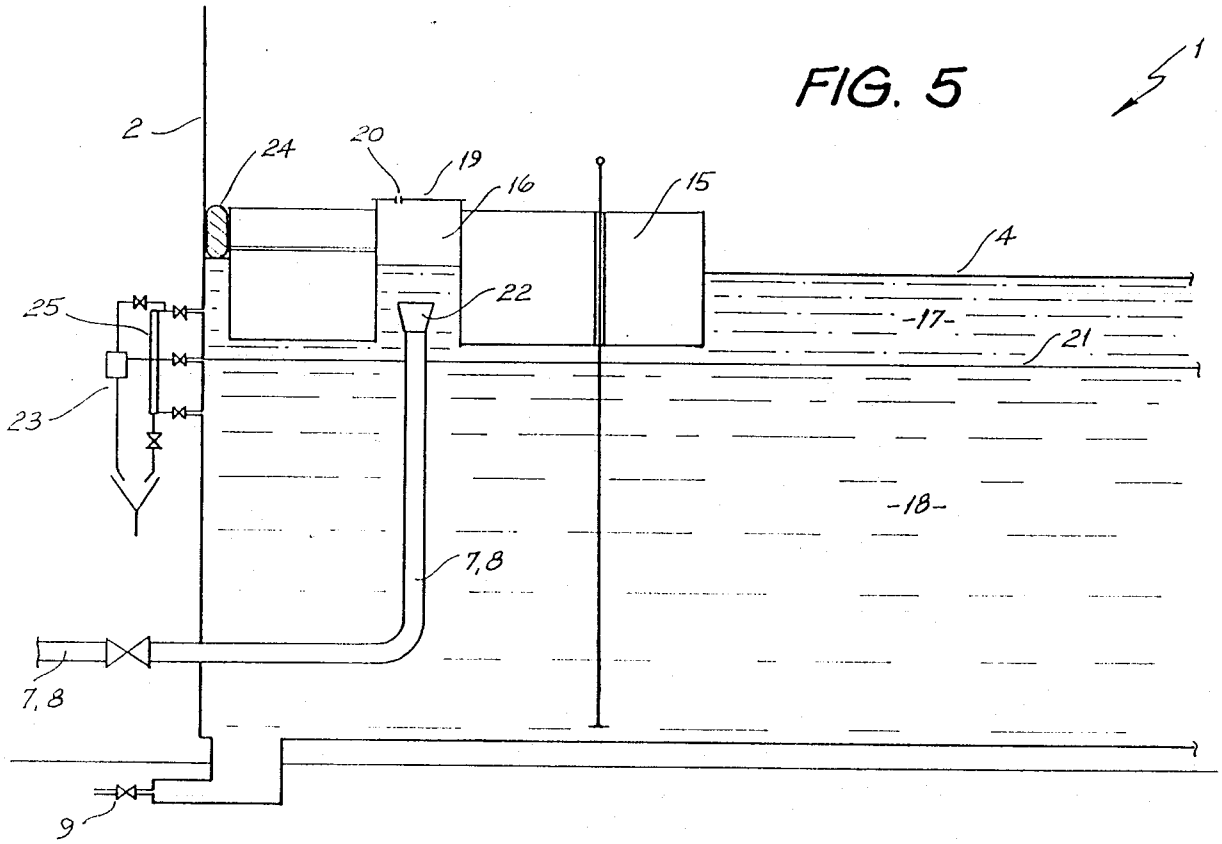
FIG. 5 is a detailed view of a portion of FIG. 4.

A first embodiment of the present invention is illustrated in FIGS. 3 to 5, and the tank 1 basically comprises the same components as the tank illustrated in FIGS. 1 and 2, but with modifications.

As is illustrated in FIGS. 3 and 4, a modified pontoon 15 incorporates a sleeve 16 which passes through the pontoon 15 to enable inlet and outlet lines 7 and 8 to project into the pontoon 15. This modification enables the product liquid 17 to be withdrawn from the tank 1 once a displacement material, namely water 18, is pumped into the tank 1. As the product liquid 17 is of a specific gravity lower than that of the water 18, the product 17 floats above and on top of, the water 18.

This embodiment is illustrated in more detail in FIG. 5 which shows the sleeve 16 through the poontoon 15 having a cover 19 incorporating a vent hole 20. The inlet/outlet lines 7 and 8, extend above the interface 21 between the liquid product 17 and water 18, thus enabling the liquid product 17 to be fed into and be withdrawn from the tank 1 without the need for the liquid product 17 to pass through the water 18. At the end of each of the inlet/outlet lines 7 and 8 is a vortex breaker 22.

Further incorporated in the tank 1 is a dual gravity drainer 23 which enables the water 18 to be kept at a constant level. The dual gravity drainer 23 is necessary due to the ingress of water falling in the form of rain, or snow which makes its way past the seal 24 and into the tank 1. Also provided in the tank 1 is a guage glass 25 to enable the exact position of the water interface 21 to be measured for accounting purposes.

It will be appreciated that the layer of water 18 at the bottom of the tank 1 displaces the liquid product 17 from the volume between the base 3 and roof 4 when the roof 4 is at its lowest level. Thus only a tiny heel of liquid product 17 remains in the tank 1.

Figure 6:
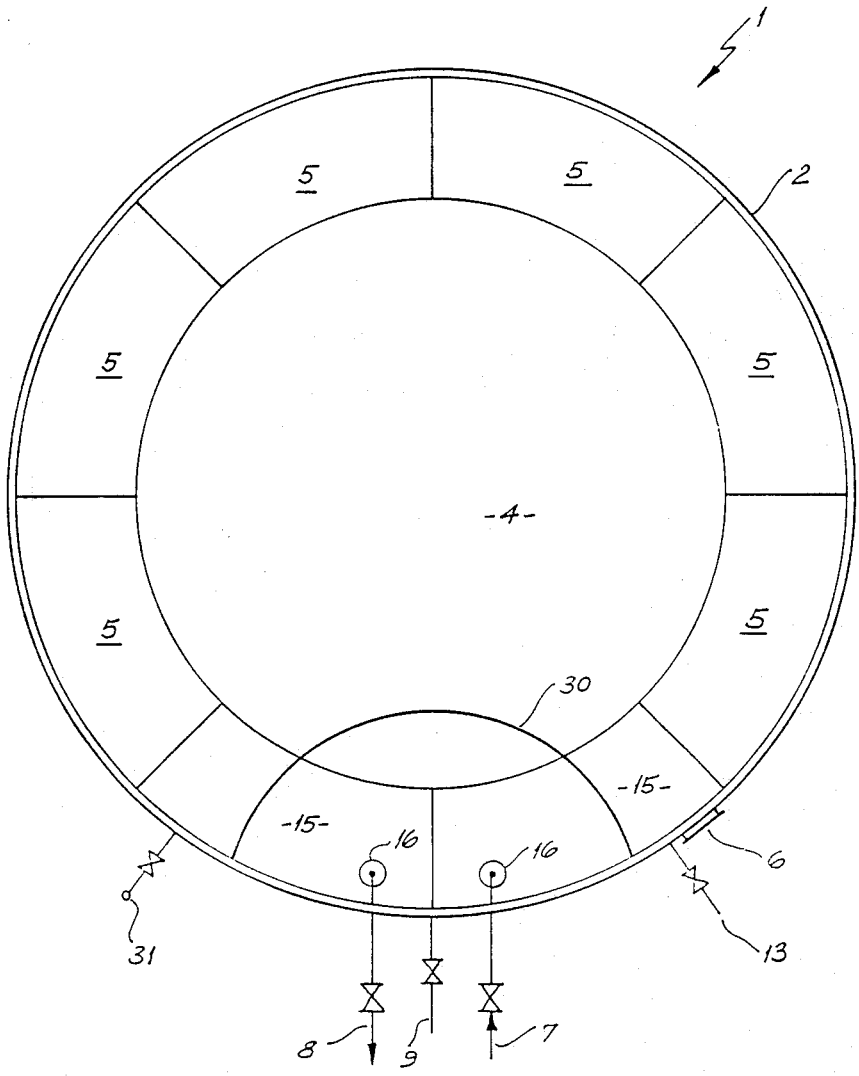
FIG. 6 is a plan view of a floating roof tank of a second embodiment of the present invention.
Figure 7:
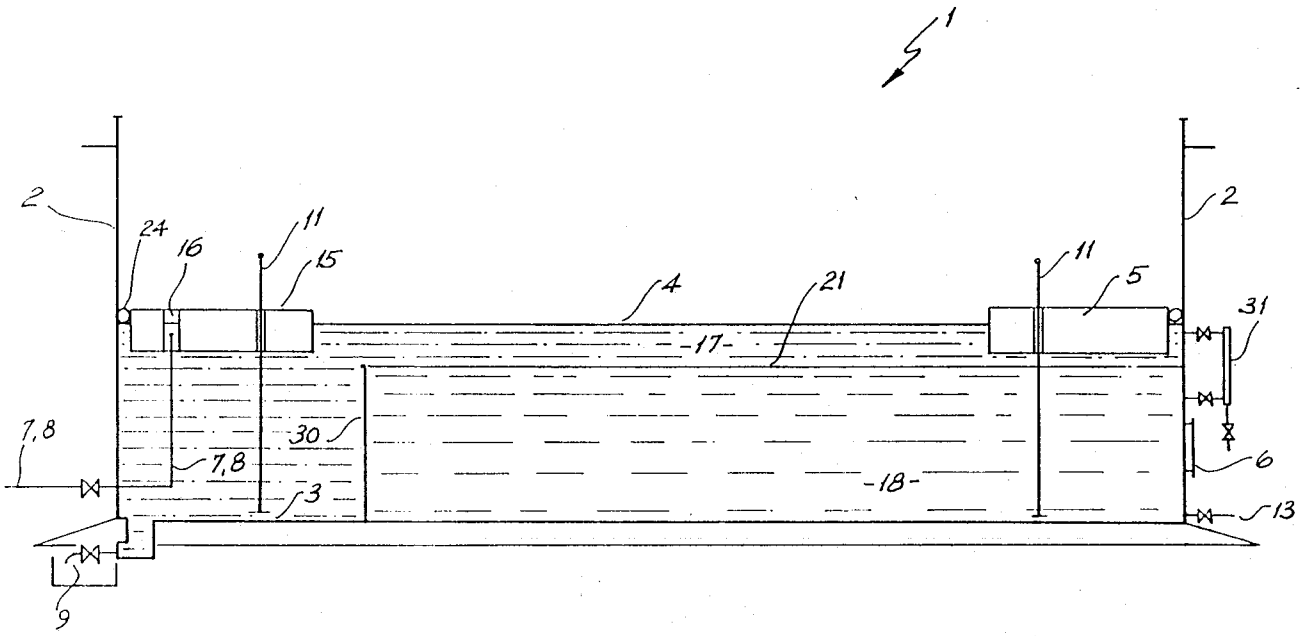
FIG. 7 is a vertical cross-section of the tank of FIG. 6.
Figure 8:
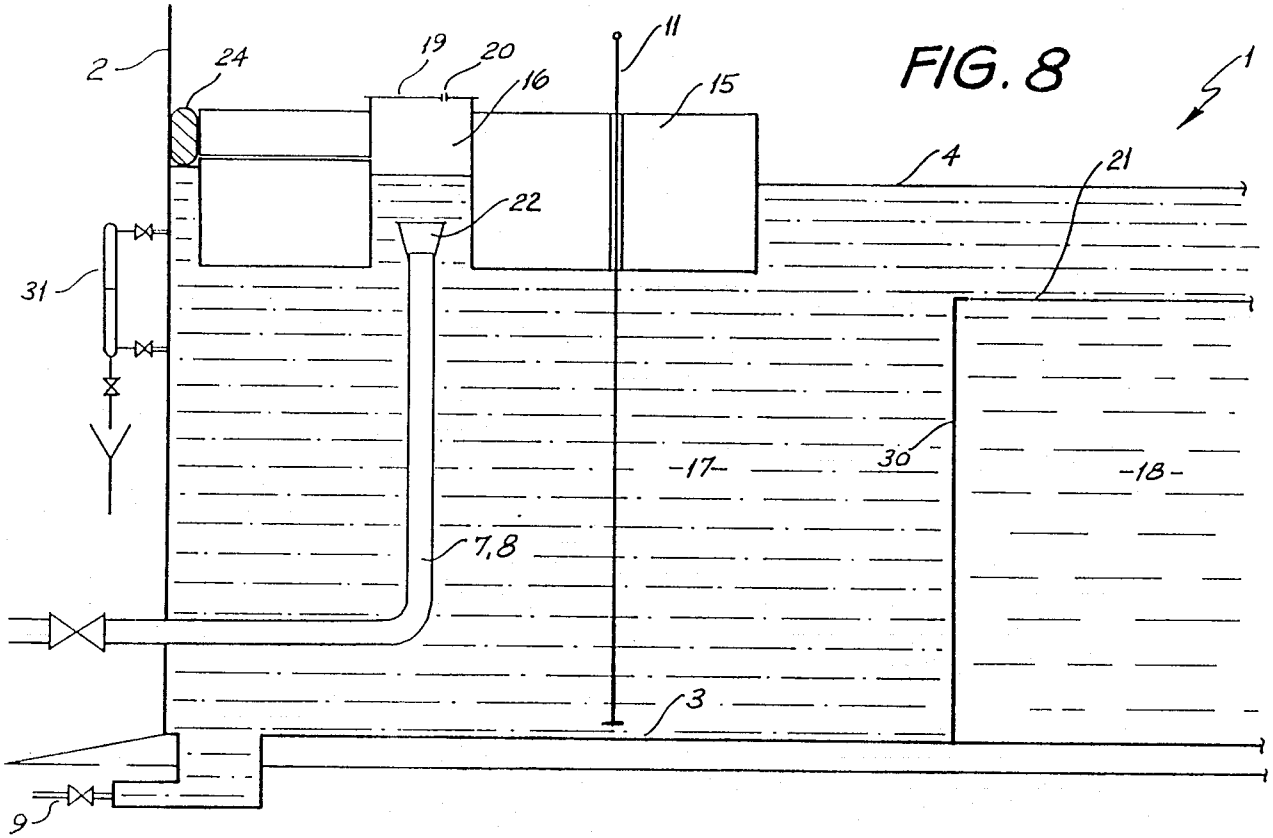
FIG. 8 is a detailed view of a portion of FIG. 7.

In a second embodiment, illustrated in FIGS. 6 to 8, an internal dam wall 30 is provided to impound the water 18. Thus the liquid product 17 is able to be withdrawn from a lower level than the inlet and outlet lines 7 and 8 of FIG. 5. However it can still be used in conjunction with extended inlet and outlet lines 7 and 8 (as is illustrated in FIG. 8). However, the gauge glass 31 is located in an area of the tank 1 which is not within the product side of the internal dam wall 30. A water fill and drain line 13 is also provided on the water side of the internal dam wall 30.

Figure 9:
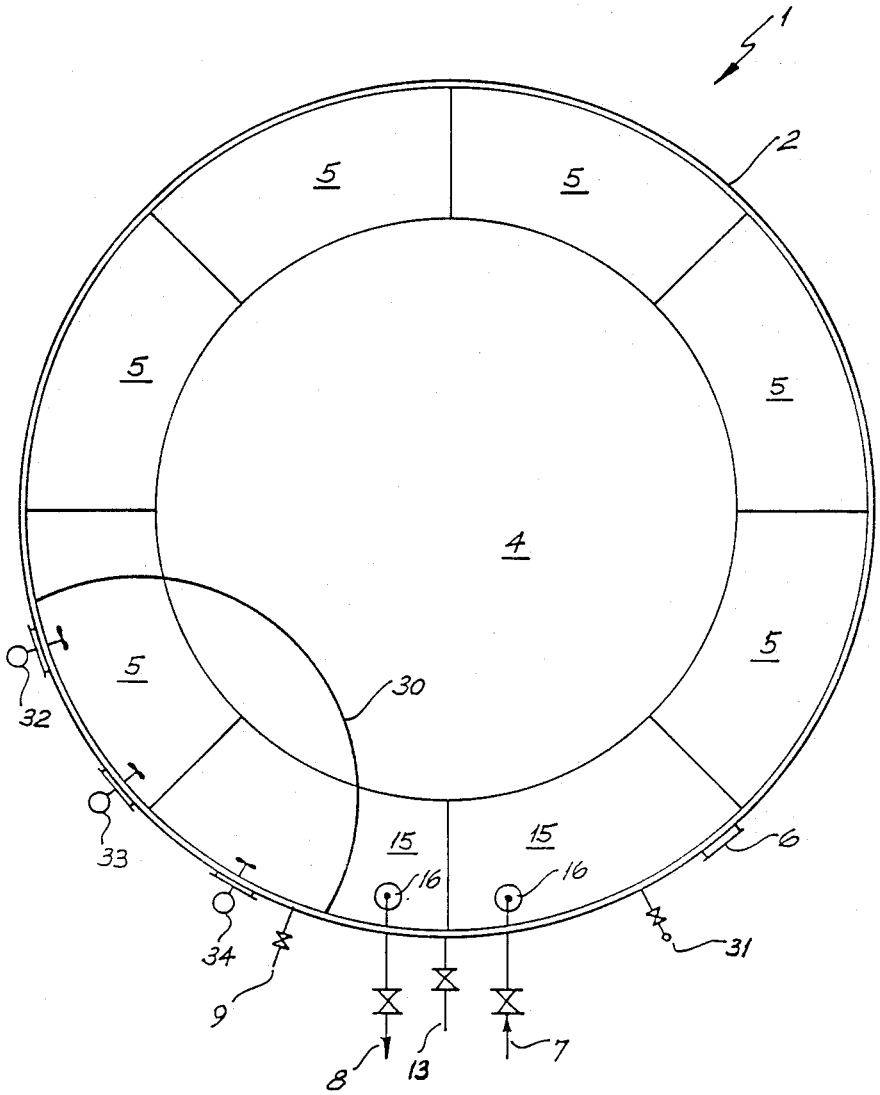
FIG. 9 is a plan view of a floating roof tank of a third embodiment of the present invention.
Figure 10:
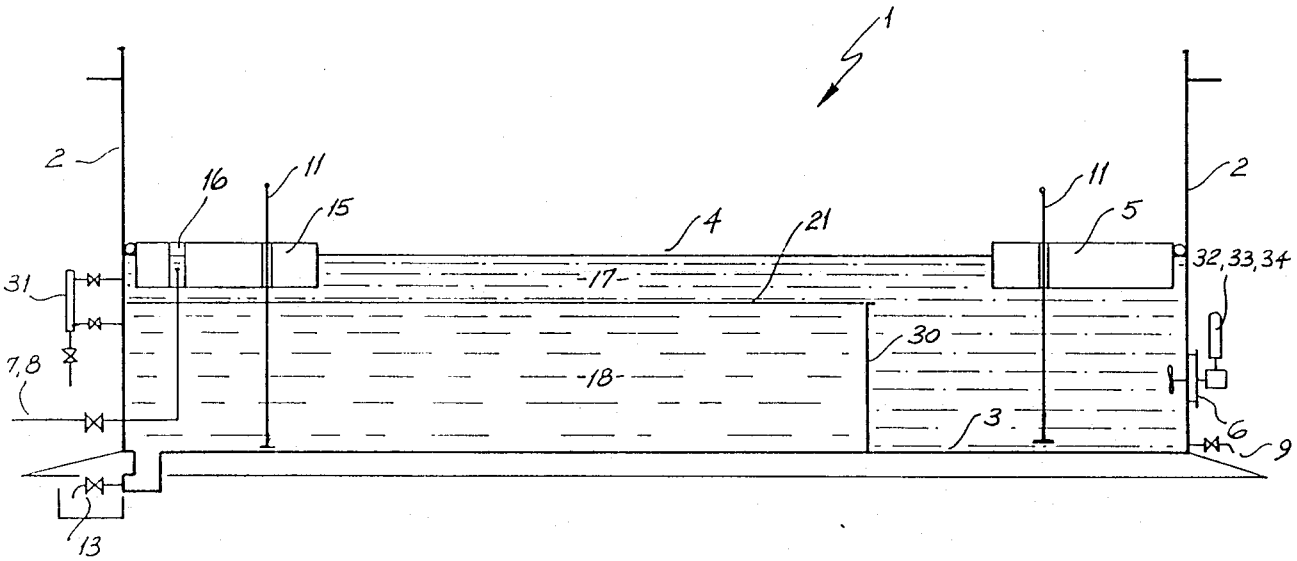
FIG. 10 is a vertical cross-section of the tank of FIG. 9.

Another embodiment is illustrated in FIGS. 9 and 10, and is employed when the tank 1 is used as a mixing tank. Electrical mixers 32, 33 and 34, allow blended gasoline and finished mixed products to be stored in, and/or produced in the tank 1. The internal dam wall 30 is constructed to a height at least just clear of the underside of the roof 4 at minimum gauge. The radius of the internal dam wall 30 is such that the distance from the mixers 32, 33 and 34 to the dam wall 30 will not adversely effect the mixing pattern within the tank 1. A typical radius for the internal dam wall 30 is approximately 10 meters. In conjunction with, or replacing the mixers 32, 33 and 34, can be bayonet heaters or the like. The inlet and outlet lines 7 and 8 for the tank 1 of FIGS. 9 and 10 are as illustrated in FIG. 5 for the tank 1 of FIGS. 3, 4 and 5.

Figure 11:
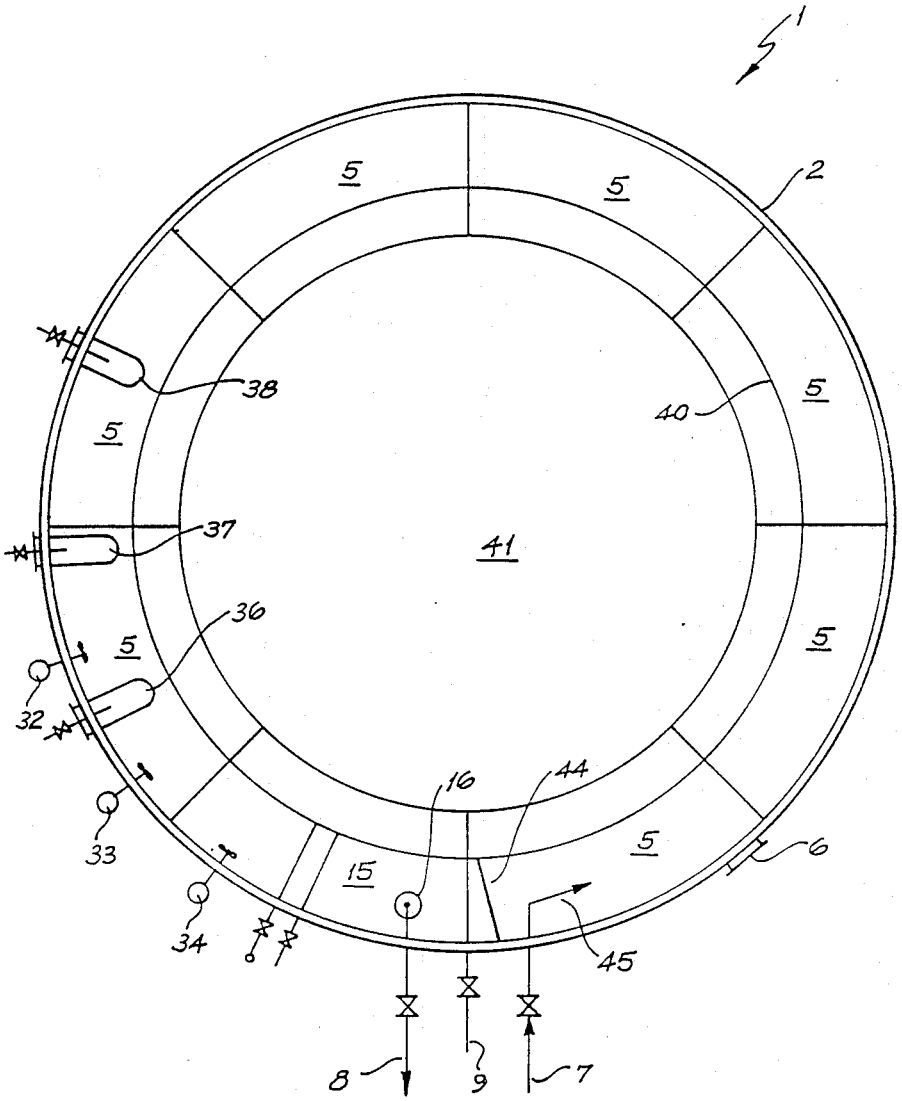
FIG. 11 is a plan view of a floating roof tank of a fourth embodiment of the present invention.
Figure 13:
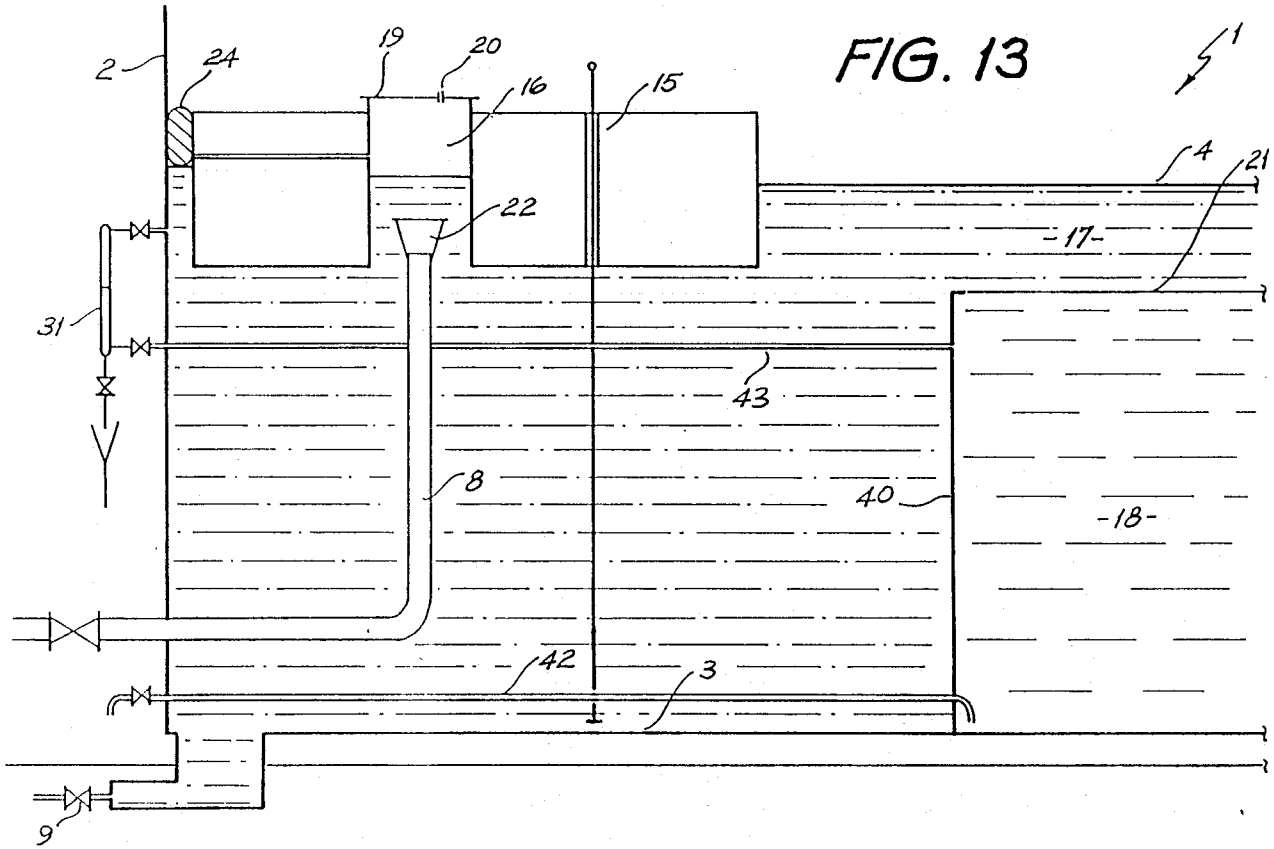
FIG. 13 is a detailed view of a portion of FIG. 12.
Figure 14:
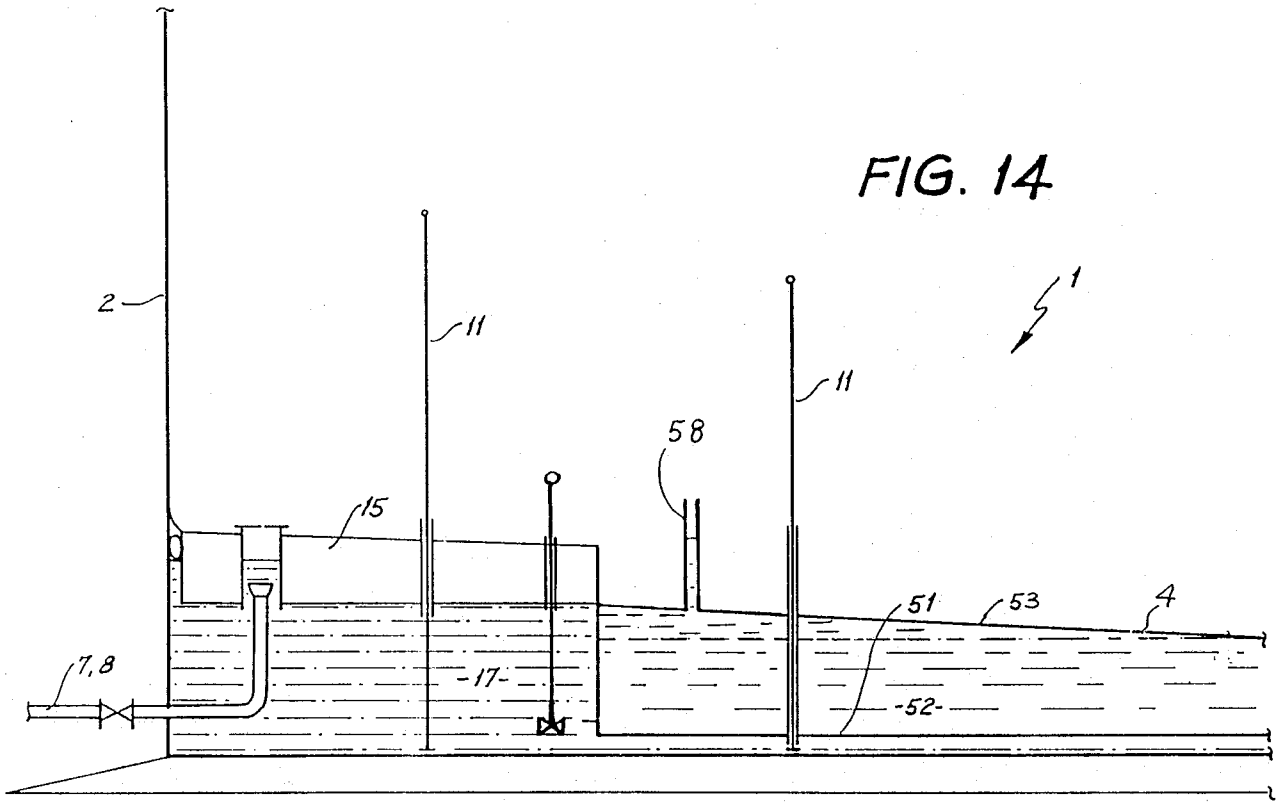
FIG. 14 is a left half vertical cross-section similar to FIG. 13 but of a floating roof tank of a fifth embodiment of the present invention.

In a further embodiment, as illustrated in FIGS. 11, 13 and 14, the tank 1 is provided with mixers (only three of which 32, 33 and 34 are illustrated) and also with bayonet heaters (again only three of which 36, 37 and 38 are illustrated). The mixers and heaters are located at regular intervals around the circumference of the tank shell 2. In this embodiment a dam wall 40 concentric with the tank shell 2 is provided. Preferably, in order to retrieve as much of the product as possible, the dam wall 40 should be of a diameter which is as large as possible but will clear both the heaters 36 to 38, and the mixers 32 to 33 as well as being located so as to not adversely effect the mixing pattern in the tank 1. It has been found that a typical dimension for the diameter of the dam 40 can be approximately 10 meters less than the diameter of the tank shell 2.

As in the other embodiments, water 18 is used and inserted into the damn cavity 41 to enable the displacement of the product 17. As the dam cavity 41 is now no longer sharing a common wall with the tank shell 2, it is necessary to include a separate drain and fill line 42 (as illustrated in FIG. 13) to communicate with the dam cavity 41. Further, it is necessary to have a modified form of gauge glass 31 to enable the respective levels of water 18 and product 17 to be measured. The modified gauge 31 includes a conduit 43 extending through the dam wall 40, to the tank shell 2.

The tank 1, further includes the angled discharge 45 (FIG. 11) on the end of the inlet 7 to enable the liquid product 17 to be discharged around the circumference of the tank shell 2. This enhances mixing and heating of the product 17. However, the creation of a complete whirlpool in the tank 1 is not beneficial to the tank operation, and as such a weir 44, approximately 300 millimeters in height is also included to break up the current produced and aid entrapment of the water contained in the product 17.

Figure 15:
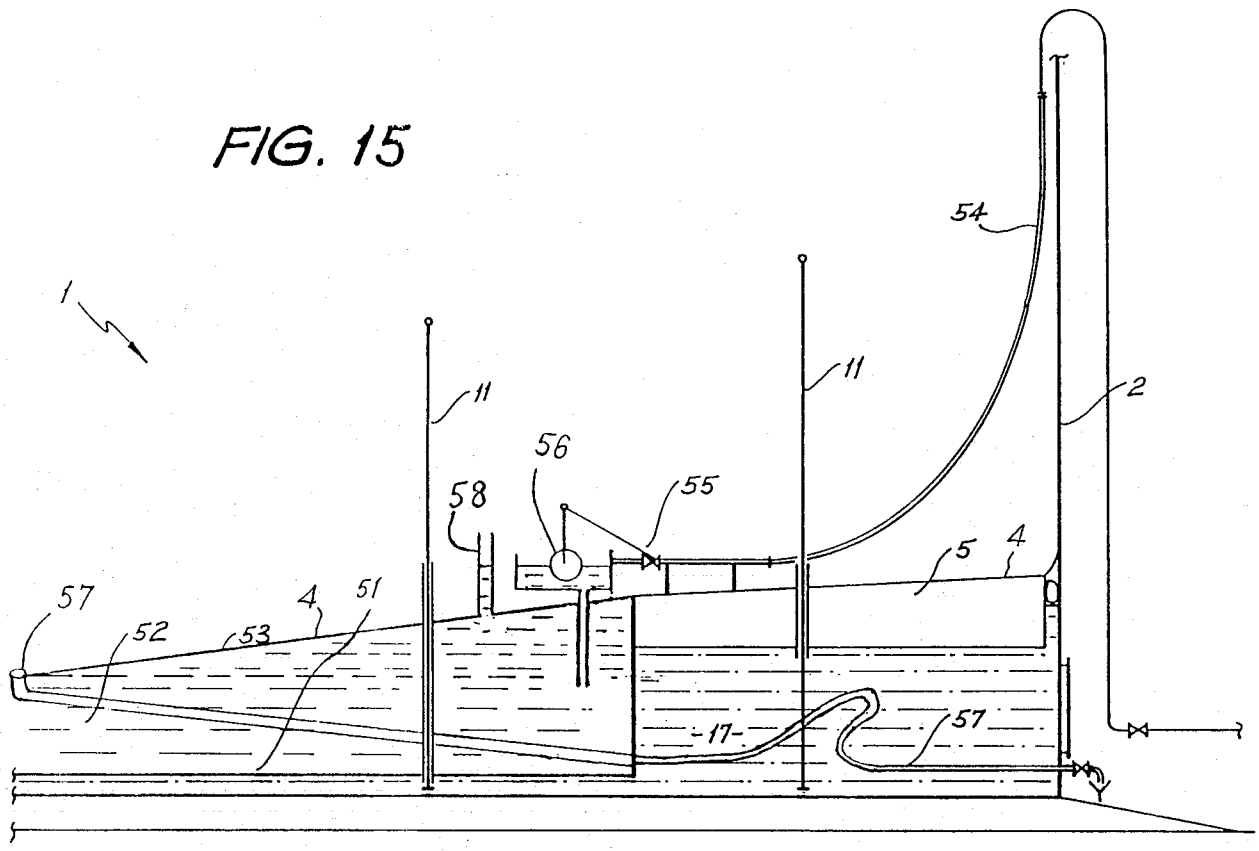
FIG. 15 is a right half vertical cross-section showing the right half of the tank of FIG. 14.

Another embodiment is illustrated in FIGS. 14 and 15, which is different from the previous embodiments in that the displacement of the product 17 is achieved by a protrusion extending from the floating tank roof 4. As is illustrated, the tank roof 4 includes a downwardly directed container 51 which contains ballast, preferably in the form of water 52. The container has a fully enclosed sloping roof 53 on top. The roof 53 is provided with one or more vents 58 and a centrally located drain 57 including a flexible hose to remove rainwater.

Modifications similar to the previous embodiments are incorporated in the inlet and outlet pipes 7 and 8 and the pontoon 15. In this embodiment, there is a flexible hose 54 (FIG. 15) communicating with the container 51 in order to maintain the amount of water 52 in the container 51. As illustrated, this can be achieved by a float valve 55 which incorporates a ball float 56.

The foregoing describes some embodiments of the present invention and modifications obvious to those skilled in the art can be made thereto without departing from the scope of the present invention.

Figure 12:
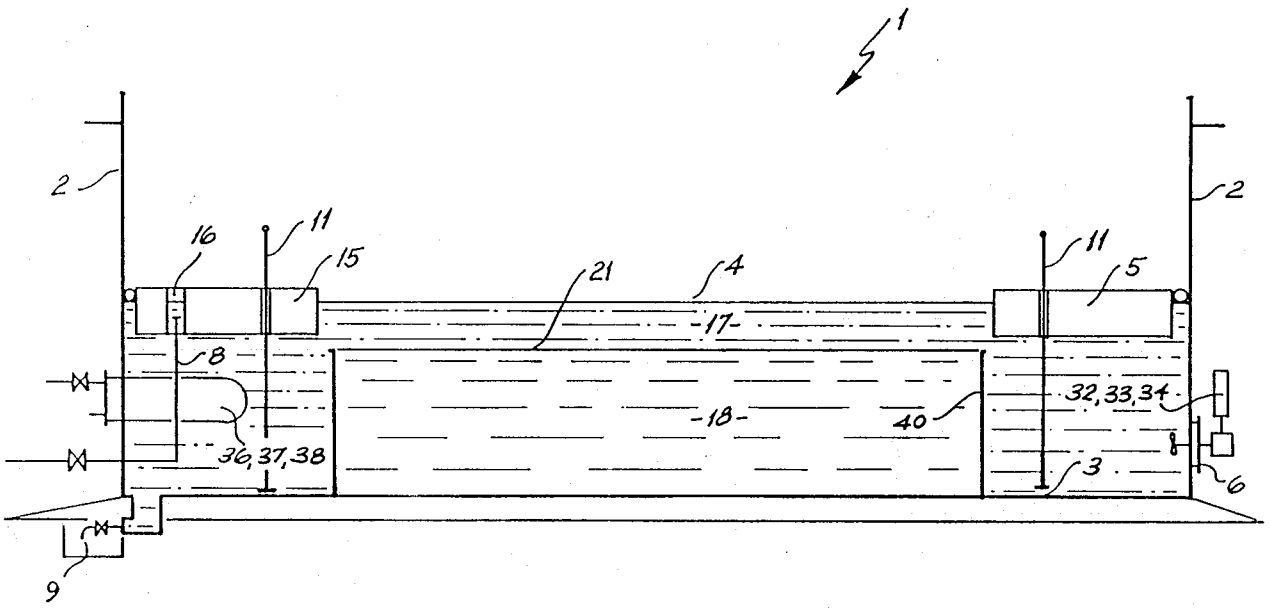
FIG. 12 is a vertical cross-section of the tank of FIG. 11.

For example, in all embodiments, water is chosen as the displacement material due to its relative cheapness and its availability. However, any material having a specific gravity greater than that of the product stored can be used. It is envisaged that new tanks can be designed to incorporate the present invention by providing a displacement volume that consists of, for example, concrete, blue metal etc. and which is built into the base of the tank. Thus the dam 40 and water 18 of FIG. 12, for example, can be replaced by a cylinder of concrete having the same exterior dimensions as the dam 40.

What I claimed is:

1. A method of operating a floating roof tank to displace an inventory heel of liquid normally located in the lowermost position of said tank, without using the full nominal capacity of said tank for the storage of said liquid, said floating roof tank comprising a tank shell supported by a fixed base and a floating roof buoyantly supported by liquid stored in said tank, said roof including legs of negligible volume projecting downwardly therefrom to support said roof at a minimum stored liquid operating level in said tank, said method comprising the steps of:

introducing ballast material into said tank to substantially fill the volume between said base and said roof when said roof is at said minimum level, maintaining the volume of said ballast material within said tank substantially constant irrespective of the position of said floating roof above said minimum level; and maintaining the configuration of said ballast material in said tank substantially constant irrespective of the position of said floating roof above said minimum level whereby the volume of said ballast material reduces the volume of said stored liquid able to be stored in said tank to less than the nominal capacity of said tank.

2. A method as claimed in claim 1 which comprises geometrically determining said constant volume and configuration by at least one fixed surface.

3. A method as claimed in claim 1 or 2 which comprises depending said ballast material from said floating roof.

4. A method as claimed in claim 3 which comprises locating said ballast material within a container which depends from said roof.

5. A method claimed in claim 4 wherein the ballast material within said container comprises water.

6. A method as claimed in claim 1 or 2 which comprises locating said ballast material adjacent the base of said tank and setting the depth of said ballast material to be less than the height of said roof above said base when said roof is at said minimum liquid level.

7. A method as claimed in claim 6 wherein said ballast material comprises a displacement liquid having a specific gravity greater than that of the stored liquid which floats on said liquid ballast.

8. A method as claimed in claim 7 including the step of restraining said displacement liquid to a substantial part only of the area of said base by retaining said displacement liquid behind a dam wall.

9. A method as claimed in claim 8 wherein said dam wall has a height substantially corresponding to the depth of said displacement liquid.

10. A method claimed in claim 8 wherein at least portion of said dam wall is vertical.

11. A method as claimed in claim 7 wherein said displacement liquid comprises water.

12. A method of operating a floating roof tank to displace an inventory heel of liquid normally located in the lowermost portion of said tank without using the full nominal capacity of said tank for the storage of said liquid, said floating roof tank comprising a tank shell supported by a fixed base and a floating roof buoyantly supported by liquid stored in said tank, said roof including legs of negligible volume projecting downwardly therefrom to support said roof at a minimum stored liquid operating level in said tank, said method comprising the steps of:

introducing ballast material into said tank to substantially fill the volume between said base and said roof when said roof is at said minimum level;

locating a dam wall on the base of said tank, the height of said dam wall being less than but closely spaced from said locating floor roof at its position corresponding to said minimum stored liquid operating level in said tank, wherein the ballast material comprises a displacement liquid having a specific gravity greater than that of the stored liquid which floats on said liquid ballast; and maintaining the volume of said liquid ballast within said tank substantially constant irrespective of the position of said floating roof above said minimum level, whereby the volume of said ballast material reduces the volume of said liquid able to be stored in said tank to less than the nominal capacity of said tank.

13. A method as claimed in claim 12 including the step of restraining said displacement liquid to a substantial part only of the area of said base.

14. A method as claimed in claim 12 or 13 wherein at least a portion of said dam wall is vertical.

15. A method as claimed in claim 12 wherein said displacement liquid comprises water.

16. A method of operating a floating roof tank to displace an inventory heel of liquid normally located in the lowermost portion of said tank, without using the full nominal capacity of said tank of the storage of said liquid, said floating roof tank comprising a tank shell supported by a fixed base and a floating roof buoyantly supported by liquid stored in said tank, said roof including legs of negligible volume projecting downwardly therefrom to support said roof at a minimum stored liquid operating level in said tank, said method comprising the steps of:

introducing ballast material into said tank to substantially fill the volume between said base and said roof when said roof is at said minimum level, wherein said ballast material depends from said floating roof;

maintaining the volume of said ballast material in said tank substantially constant irrespective of the position of said floating roof above said minimum level; and maintaining the configuration of said ballast material in said tank substantially constant irrespective of the position of said floating roof above said minimum level whereby the volume of said ballast material reduces the volume of said stored liquid able to be stored in said tank to less than the nominal capacity of said tank.

17. A method as claimed in claim 16 wherein said ballast material comprises a liquid within a container which depends from said roof.

18. A method claim in claim 17 wherein the ballast liquid within said container comprises water.

19. A method of operating a floating roof tank to displace an inventory heel of liquid normally located in the lowermost portion of said tank, without using the full nominal capactiy of said tank for the storage of said liquid, said floating roof tank comprising a tank shell supported by a fixed base and a floating roof buoyantly supported by liquid stored in said tank, said roof including legs of negligible volume projecting downwardly therefrom to support said roof at a minimum stored liquid operating level in said tank, said method comprising the steps of:

introducing ballast material into said tank adjacent said base to substantially fill the volume between said base and said roof when said roof is at minimum level, wherein the specific gravity of said ballast material is greater than that of said stored liquid and said stored liquid is in direct contact with said ballast material;

maintaining the volume of said ballast material within said tank substantially constant irrespective of the position of said floating roof above said minimum level; and maintaining the configuation of said ballast material in said tank substantially constant irrespective of the position of said floating roof above said minimum level whereby the volume of said ballast material reduces the volume of said stored liquid able to be stored in said tank to less than the nominal capacity of said tank.

20. A method as claimed in claim 19 wherein said ballast material comprises a displacement liquid.

21. A method as claimed in claim 20 wherein said displacement liquid comprises water.

22. A method as claimed in claim 19 or 20 which comprises flooding with said complacement liquid the lowermost portion of said tank above said base.

23. A floating roof storage tank, comprising:

a tank shell supported by a fixed base and a floating roof buoyantly supported by liquid stored in said tank, said roof including legs of negligible volume projecting downwardly therefrom to support said roof at a minimum operating stored liquid level in said tank;

a displacement mass located within said tank to substantially fill the volume between said base and said roof when said roof is at a minimum level, wherein said replacement mass within said tank is of substantially constant volume and configuration, said volume and configuration being geometrically determined by at least one fixed surface, the constant volume of said displacement mass reducing the volume of said stored liquid able to be stored in said tank to less than the nominal capacity of said tank.

24. A tank as claimed in claim 23 wherein said displacement mass projects downwardly from said roof and in movable with said roof.

25. A tank as claimed in claim 24 wherein said displacement mass comprises a container.

26. A tank as claimed in claim 25 wherein said container is filled with ballast.

27. A tank as claimed in claim 26 wherein said ballast comprises water.

28. A tank as claimed in claim 23 wherein said displacement mass comprises a layer of ballast adjacent the base of said tank.

29. A tank as claimed in clim 28 wherein said ballast comprises a liquid having a specific gravity greater than the stored liquid which floats on said liquid ballast.

30. A tank as claimed in claim 29 which further comprises a dam located on said base for containing said liquid ballast.

31. A tank as claimed in claim 30 wherein at least part of said dam comprises a vertical wall.

32. A tank as claimed in claim 30 or 31 wherein said dam is spaced from said tank shell.

33. A tank as claimed in claim 32 wherein said dam and said shell are each substantially annular with the external diameter of said dam being less than the internal diameter of said tank shell.

34. A tank as claimed in claim 30 or 31 wherein said dam extends between two spaced apart locations on the interior of said tank shell.

35. A tank as claimed in claim 24 wherein when viewed in plan at least a part of said dam is radial relative to said tank shell.

36. A tank as claimed in claim 24 wherein when viewed in plan said dam is substantially arcuate.

37. A tank as claimed in claim 24 wherein said dam is of substantially uniform height throughout its length.

38. A tank as claimed in claim 29 wherein inlet/outlet conduit means for the stored liquid supporting said roof are located within the liquid ballast contained within said tank and extend above the level of liquid ballast in said tank.

39. A tank as claimed in claim 30 wherein inlet/outlet conduit means for the stored liquid pass through said tank shell below the level of liquid ballast in said dam and are located outside said dam.

40. A tank as claimed in claim 29, which comprises fill/drain conduit means communicating between said liquid ballast and the exterior of said tank.

41. A tank as claimed in claim 29 wherein said tank has a gauge glass exterior of said tank and communicating with both said stored liquid and said liquid ballast to indicate the level of said liquid ballast within said tank.

42. A tank as claimed in claim 29 wherein said liquid ballast comprises water.

43. A floating roof storage tank, comprising:

a tank shell supported by a fixed base and a floating roof buoyantly supported by liquid stored in said tank, said roof including legs of negligible volume projecting downwardly therefrom to support said roof at a minimum operating stored liquid level in said tank;

a displacement mass located within said tank to substantially fill the volume between said base and said roof when said roof is at a minimum level; a dam located on the base of said tank, the height of said dam being less than but closely spaced from said floating roof at a position corresponding to said minimum stored liquid operating level in said tank, wherein the displacement mass comprises a ballast liquid having a specific gravity greater than that of the stored liquid which floats on said liquid ballast, and wherein the volume of said ballast liquid within said tank is maintained substantially constant irrespective of the position of said floating roof above said minimum level, whereby the volume of said ballast liquid reduces the volume of said liquid able to be stored in said tank to less than the nominal capacity of said tank.

44. A tank is claimed in claim 43 wherein said dam includes means for restraining said ballast liquid to a substantial part only of the area of said base.

45. A tank claimed in claim 43 or 44 wherein at least part of said dam is vertical.

46. A tank as claimed in claim 43 wherein said dam is spaced from said tank shell.

47. A tank as claimed in claim 46 wherein said dam and said tank shell are each substantially annular with the external diameter of said dam being less than the internal diameter of said tank shell.

48. A tank as claimed in claim 43 wherein said dam extends between two spaced apart locations on the interior of said tank shell.

49. A tank as claimed in claim 48 wherein when viewed in plan at least a part of said dam is radial relative to said tank shell.

50. A tank as claimed in claim 48 or 49 wherein when viewed in plan said dam is substantially arcuate.

51. A tank as claimed in claim 43 wherein said dam is of substantially uniform height throughout its length.

52. A tank as claimed in claim 43 wherein inlet/outlet conduit means for the stored liquid are located within the liquid ballast contained within said tank and extend above the level of liquid ballast in said tank.

53. A tank as claimed in claim 43 wherein inlet/outlet conduit means for the stored liquid pass through said tank shell below the level of liquid ballast in said dam and are located outside said dam.

54. A tank as claimed in claim 43 having fill/drain conduit means communicating between said liquid ballast and the exterior of said tank.

55. A tank claimed in claim 43 wherein said tank has a gauge glass exterior of said tank and communicating with both said stored liquid and said liquid ballast to indicate the level of said liquid ballast within said tank.

56. A tank as claimed in claim 43 wherein said liquid ballast comprises water.

57. A floating roof storage tank, comprising:

a tank shell supported by a fixed base and floating roof buoyantly supported by liquid stored in said tank, said roof including legs of negligible volume projecting downwardly therefrom to support said roof at a minimum operating stored liquid level in said tank;

a ballast material located within said tank to substantially fill the volume between said base and said roof when said roof is at minimun level, wherein said ballast material depends from said floating roof;

means for maintaining the volume of said ballast material in said tank substantially constant irrespective of the position of said floating roof above said minimum level; and means for maintaining the configuration of said ballast material in said tank substantially constant irrespective of the position of said floating roof above said minimum level whereby the volume of said ballast material reduces the volume of said stored liquid able to be stored in said tank to less than the nominal capacity of said tank.

58. A tank as claimed in claim 57 wherein said ballast material comprises a liquid and is located within a container which depends from said roof.

59. A tank as claimed in claim 58 wherein the ballast liquid within said container comprises water.

60. A floating roof tank, comprising:

a tank shell supported by a fixed base and a floating roof buoyantly supported by liquid stored in said tank, said roof including legs of negligible volume projecting downwardly therefrom to support said roof at a minimum stored liquid operating level in said tank;

a ballast material positioned in said tank adjacent said base for substantially filling the volume between said base and said roof when said roof is at minimum level wherein the specific gravity of said ballast material is greater than than of said stored liquid and said stored liquid is in direct contact with said ballast material;

means for maintaining the volume of said ballast material within said tank substantially constant irrespective of the position of said floating roof above said minimum level; and means for maintaining the configuration of said ballast material in said tank substantially constant irrespective of the position of said floating roof above said minimum level whereby the volume of said ballast material reduces the volume of said stored liquid able to be stored in said tank to less than the nominal capacity of said tank.

61. A tank as claimed in claim 60 wherein said ballast material comprises a displacement liquid.

62. A tank as claimed in claim 61 wherein said displacement liquid comprises water.

63. A tank as claimed in claim 60 or 61, wherein said displacement liquid floods the lowermost portion of said tank above said base.

64. A tank as claimed in claim 61 wherein said tank has a gauge glass exterior of said tank and communicating with both said stored liquid and said liquid ballast to indicate the level of said liquid ballast within said tank.

* * * * *